United States Patent [19]

Christian et al.

[11] 4,431,556

[45] Feb. 14, 1984

[54] OXIDATION STABLE POLYFLUOROALKYLETHER GREASE COMPOSITIONS

[75] Inventors: John B. Christian, Yellow Springs; Christ Tamborski, Dayton, both of Ohio

[73] Assignee: The United States of America as represented by the Secretary of the Air Force, Washington, D.C.

[21] Appl. No.: 418,114

[22] Filed: Sep. 14, 1982

[51] Int. Cl.[3] ..... C10M 3/24

[52] U.S. Cl. ..... 252/49.9

[58] Field of Search ..... 252/49.9, 49.6

[56] References Cited

U.S. PATENT DOCUMENTS

| | | | |
|---|---|---|---|
| 3,393,151 | 7/1968 | Dolle, Jr. et al. | 252/49.9 |
| 3,481,872 | 12/1969 | Dolle, Jr. et al. | 252/49.9 |
| 3,483,129 | 12/1969 | Dolle, Jr. et al. | 252/49.9 |
| 3,499,041 | 3/1970 | Tamborski | 260/612 |
| 3,567,802 | 3/1971 | Garth | 260/950 |
| 3,665,041 | 5/1972 | Sianesi et al. | 260/615 A |
| 3,715,378 | 2/1973 | Sianesi et al. | 260/463 |
| 3,847,978 | 11/1974 | Sianesi et al. | 260/535 H |
| 4,011,267 | 3/1977 | Tamborski et al. | 260/606.5 P |
| 4,043,926 | 8/1977 | Snyder et al. | 252/49.9 |
| 4,097,388 | 6/1978 | Snyder, Jr. et al. | 252/49.9 |
| 4,132,660 | 1/1979 | Christian et al. | 252/51.5 R |

*Primary Examiner*—Jacqueline V. Howard

*Attorney, Agent, or Firm*—Donald J. Singer; Charles E. Bricker

[57] ABSTRACT

A grease composition comprising a major amount of a polyfluoroalkylether base fluid of the general formula $$AO(CF_2CF_2O)_m(CF_2O)_nB$$

wherein A and B are $—CF_3$ or $—C_2F_5$, and m and n are integers and the sum of m+n is between 2 and 200 and the ratio n/m is in the range of 0.1:1 to 10:1, a minor amount of a thickener and an oxidation inhibiting amount of a perfluoroalkylether phenylphosphine of the general formula $$(O)_a—P(—Ar—CF_2—R_fOR_f)_3$$

wherein a has a value of zero or 1, Ar is a phenylene or perfluorophenylene group, and $—R_fOR_f$ is a perfluoroalkylether group containing at least one ether linkage.

8 Claims, No Drawings

OXIDATION STABLE POLYFLUOROALKYLETHER GREASE COMPOSITIONS

RIGHTS OF THE GOVERNMENT

The invention described herein may be manufactured and used by or for the Government of the United States for all governmental purposes without the payment of any royalty.

BACKGROUND OF THE INVENTION

This invention relates to grease compositions.

Primarily because of their thermal stability, it has been recognized that polyfluoroalkylether fluids have great potential for use as lubricants. The prior art discloses greases formulated from such fluids and thickeners such as a fluorinated copolymer of ethylene and propylene or a polymer of tetrafluoroethylene. These greases have proven to be useful over a wide range of temperatures, e.g., as low as −40° F. and as high as 600° F. Although such greases have been found to possess superior lubricating characteristics for short periods of time, their utility has been limited by their inability to provide long term high temperature stability in an oxidizing atmosphere.

Accordingly, it is an object of this invention to provide a novel grease composition based upon a polyfluoroalkylether fluid.

Other objects and advantages of the present invention will become apparent to those skilled in the art upon consideration of the following disclosure.

DESCRIPTION OF THE INVENTION

In accordance with the present invention there is provided a grease composition comprising a major amount of a polyfluoroalkylether base fluid, a minor amount of a thickener and an oxidation inhibiting amount of a perfluoroalkylether phenylphosphine.

The polyfluoroalkylether base fluid employed in the grease compositions of the present invention have the general formula $$AO(CF_2CF_2O)_m(CF_2O)_nB$$

wherein A and B may be the same or different and each may be $CF_3$— or $C_2F_5$—, m and n are integers whose sum is between 2 and 200 and the ratio n/m is between 0.1 and 10.

The $(CF_2CF_2O)_m$ and $(CF_2O)_n$ groups of the fluorinated polyethers are randomly distributed in the polyether molecules. The integers m and n can also be defined as having values such that the fluorinated polyethers have a kinematic viscosity ranging from about 15 to about 1000 centistokes (cs) at 100° F. as determined by the method of ASTM D445. The fluorinated polyethers are normally obtained as mixtures of molecules, each of which has a well defined molecular weight. The usual practice is to fractionate the mixture so as to obtain a product having a desired average molecular weight or a desired kinematic viscosity. A more complete discussion of the fluorinated polyethers may be found in U.S. Pat. No. 3,715,378 issued to D. Sianesi et al on Feb. 6, 1973. These fluorinated polyethers are available commercially from Montedison S.p.a., Milan, Italy, under the designation Fomblin Z, one particularly useful fraction of which has a viscosity of about 130 cs at 100° F.

As a thickener, it is generally preferred to employ a fluorinated ethylene-propylene copolymer (FEP) or a polytetrafluoroethylene (PTFE). The copolymer usually has a molecular weight in the approximate range of 120,000 to 190,000, preferably about 140,000 to 160,000, a density of about 2.39 to 2.47 g/cc, a surface area of about 10.0 $m^2/g$, and a particle size of about 0.15 micron. The polytetrafluoroethylene usually has a molecular weight in the approximate range of 2,000 to 50,000, preferably about 10,000 to 50,000, a density of about 2.15 to 2.28 g/cc, a surface area of 7–8 $m^2/g$, and a particle size of 1–2 microns. These polymeric thickeners are well known materials and will not be further discussed.

The antioxidant employed in the greases of this invention has the general formula $$(O)_a—P(—Ar—CF_2—R_fOR_f)_3$$

where a has a value of zero or 1, Ar is a phenylene group or a perfluorophenylene group, and $—R_fOR_f$ is a perfluoroalkylether group containing at least one ether linkage. Examples of such $—R_fOR_f$ groups include the following:

$$—CF(CF_3)[OCF_2CF(CF_3)]_xOC_3F_7,$$

$$—CF_2(OCF_2CF_2)_yOC_2F_5, \text{ and}$$

$$—CF_2(OCF_2)_zOCF_3,$$

where x, y and z are zero or an integer having a value of 1 to 20, preferably 1–4.

The antioxidant compounds of the above formula in which Ar is a phenylene group and a is zero are new compounds. A detailed description of the synthesis of these compounds is contained in application Ser. No. 418,115, filed of even date herewith by C. Tamborski, C. E. Snyder, Jr., and J. B. Christian, the disclosure of which is incorporated herein by reference.

The grease compositions of the present invention comprise about 68 to 72 weight percent of the base fluid described previously, about 27 to 32 weight percent of thickener, and about 1 to 3 weight percent of the above described antioxidant, all based upon the total weight of compounded grease.

The following example illustrates the invention.

EXAMPLE

A series of grease compositions were prepared using as antioxidants the following:

(A)

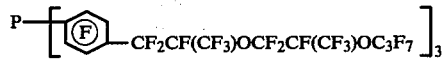

(B)

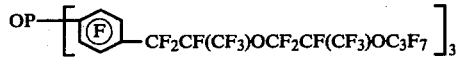

(C)

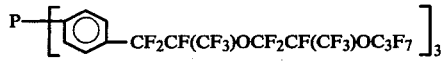

-continued (D)

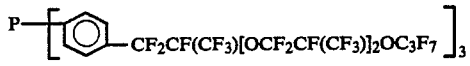

These antioxidants are designated AO—A, AO—B, AO—C and AO—D, respectively, in the Table below.

The base fluid had the formula given previously. This base fluid had a viscosity of about 130 cs at 100° F.; it is available commercially under the trademark Fomblin Z.

The thickeners employed were (a) FEP having an average molecular weight of 150,000, available under the designation TL-120 from Liquid Nitrogen Processing Co., Malvern, Pa., and (b) PTFE having a molecular weight of 30,000, available under the designation TL-102 from the same source.

The grease compositions were prepared by mixing and stirring each of the recipes set forth in the following Table until a uniform mixture was obtained (amounts given are in weight percent). Each mixture was further blended to a grease consistency by passing each mixture twice through a 3-roll mill at about 77° F. with the rollers set at an opening of 0.0015 to 0.002 inch.

The various grease compositions were tested in accordance with standard test procedures. The penetration test was carried out as prescribed by Federal Test Method Standard 791a, Method 313. The evaporation test was carried out as prescribed by ASTM Method D2595. The results of these tests are given in the following Table.

and the ratio n/m is in the range of 0.1:1 to 10:1, a minor amount of a thickener and an oxidation inhibiting amount of a perfluoroalkylether phenylphosphine of the general formula $$P(Ar—CF_2—R_fOR_f)_3$$

wherein Ar is a phenylene group and $—R_fOR_f$ is a perfluoroalkylether group containing at least one ether linkage.

2. The composition of claim 1 wherein $—R_fOR_f$ is selected from the group consisting of $$—CF(CF_3)[OCF_2CF(CF_3)]_xOC_3F_7,$$

$$—CF_2(OCF_2CF_2)_yOC_2F_5, \text{ and}$$

$$—CF_2(OCF_2)_zOCF_3$$

wherein x, y and z each has a value in the range of 1 to 20.

3. The composition of claim 1 wherein the amount of base fluid is in the approximate range of 68 to 72 weight percent, the amount of thickener is in the approximately range of 27 to 32 weight percent and the amount of said phosphine 1 to 3 weight percent.

4. The composition of claim 1 wherein said thickener is selected from the group consisting of fluorinated ethylene-propylene copolymer having a molecular weight of about 120,000 to 190,000, and polytetrafluoroethylene having a molecular weight of about 2,000 to 50,000.

TABLE

| | Run No. | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | Control |
| Base Fluid | 69 | 68 | 69 | 68 | 69 | 68 | 69 | 68 | 69 | 68 | 69 | 68 | 69 | 68 | 69 | 68 | 70 |
| FEP | 30 | 29 | — | — | 30 | 29 | — | — | 30 | 20 | — | — | 30 | 29 | — | — | — |
| PTFE | — | — | 30 | 29 | — | — | 30 | 29 | — | — | 30 | 29 | — | — | 30 | 29 | 30 |
| AO-A | 1 | 3 | 1 | 3 | | | | | | | | | | | | | |
| AO-B | | | | | 1 | 3 | 1 | 3 | | | | | | | | | |
| AO-C | | | | | | | | | 1 | 3 | 1 | 3 | | | | | |
| AO-D | | | | | | | | | | | | | 1 | 3 | 1 | 3 | |
| Penetration, decimillimeters | 292 | 292 | 290 | 289 | 274 | 274 | 282 | 306 | 287 | 309 | 288 | 294 | 283 | 286 | 290 | 294 | 277 |
| Evaporation at 450° F. (%) | | | | | | | | | | | | | | | | | |
| 22 hrs | 2.2 | 2.6 | 2.0 | 2.1 | 1.2 | 1.3 | 1.3 | 1.4 | 1.1 | 22.1 | 1.1 | 2.0 | 10 | 10 | 5.5 | 4.1 | 14 |
| 72 hrs | 3.2 | 3.5 | 3.1 | 3.3 | 1.3 | 1.7 | 1.3 | 1.5 | 1.5 | 2.9 | 1.3 | 2.9 | 15 | 13 | 11 | 10 | 37 |
| 168 hrs | 3.6 | 4.0 | 3.3 | 4.1 | 1.3 | 1.9 | 1.7 | 1.7 | 1.8 | 3.1 | 1.8 | 3.2 | 16 | 15 | 12 | 12 | 60 |
| 336 hrs | 4.7 | 5.8 | 4.8 | 4.7 | 52 | 54 | 54 | 62 | 6.2 | 3.2 | 2.6 | 6.2 | 18 | 15 | 14 | 14 | 65 |
| Condition of grease at end of test* | S | S | S | S | ST | ST | ST | H | S | S | S | S | S | S | S | S | D |

*S = Soft; ST = Stiff; H = Hard; D = Dry.

The above data illustrate that the grease compositions of this invention do not volatilize or oxidize under conditions of high temperature.

Modifications of the invention can be made in view of the foregoing disclosure without departing from the spirit of the invention and the scope of the following claims.

We claim:

1. A grease composition comprising a major amount of a polyfluoroalkylether base fluid of the general formula $$AO(CF_2CF_2O)_m(CF_2O)_nB \quad \text{(a)}$$

wherein A and B are $—CF_3$ or $—C_2F_5$, and m and n are integers and the sum of m and n is between 2 and 200

5. The composition of claim 1 wherein said base fluid has a viscosity of about 130 cs at 100° F., said thickener is fluorinated ethylene-propylene copolymer and said phosphine has the formula

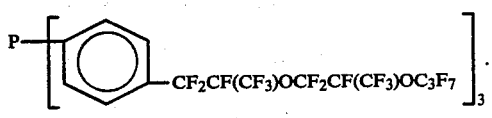

6. The composition of claim 1 wherein said base fluid has a viscosity of about 130 cs at 100° F., said thickener is polytetrafluoroethylene and said phosphine has the formula

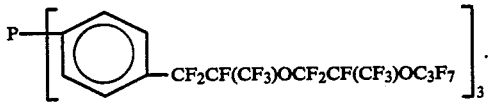
7. The composition of claim 1 wherein said base fluid has a viscosity of about 130 cs at 100° F., said thickener is fluorinated ethylenepropylene copolymer and said phosphine has the formula
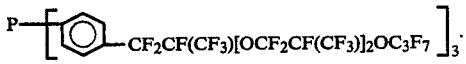
8. The composition of claim 1 wherein said base fluid has a viscosity of about 130 cs at 100° F., said thickener is polytetrafluoroethylene and said phosphine has the formula
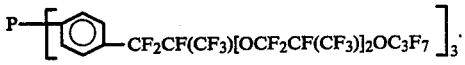
* * * * *